US005839876A

United States Patent [19]

McCarthy et al.

[11] Patent Number: 5,839,876

[45] Date of Patent: Nov. 24, 1998

[54] LIFT AND ROTATE DOLLY

[76] Inventors: Cornelius McCarthy; Charles Bacella, both of 3223 Whitney Ave., Brooklyn, N.Y. 11229

[21] Appl. No.: 702,907

[22] Filed: Aug. 26, 1996

[51] Int. Cl.[6] ..... B66F 9/06

[52] U.S. Cl. ..... 414/590; 414/641

[58] Field of Search ..... 414/423, 589, 414/590, 620, 628, 629, 639, 640, 641, 672

[56] References Cited

U.S. PATENT DOCUMENTS

| | | | |
|---|---|---|---|
| 2,473,659 | 6/1949 | Musgrave | 414/640 |
| 2,524,085 | 10/1950 | Saul, Jr. | 414/590 |
| 2,828,870 | 4/1958 | Corley | 414/589 X |
| 3,191,788 | 6/1965 | Hopfeld | 414/620 X |
| 3,587,892 | 6/1971 | Vermette | 414/620 X |
| 4,369,014 | 1/1983 | Jolivet | 414/589 X |
| 4,370,089 | 1/1983 | Hoster | 414/589 |
| 4,711,407 | 12/1987 | Boon . | |
| 4,810,151 | 3/1989 | Shern | 414/590 X |
| 5,051,056 | 9/1991 | Gibbons et al. | 414/590 X |
| 5,257,892 | 11/1993 | Branch | 414/490 |
| 5,415,516 | 5/1995 | Richards | 414/458 |
| 5,441,378 | 8/1995 | Puls | 414/458 |
| 5,449,266 | 9/1995 | Evans | 414/458 |

FOREIGN PATENT DOCUMENTS

| | | | |
|---|---|---|---|
| 0808338 | 7/1951 | Germany | 414/641 |

*Primary Examiner*—James W. Keenan

[57] ABSTRACT

A lift and rotate dolly (10) functioning to allow a user to lift and rotate material (22) in situations where space is limited such as an elevator. The lift and rotate dolly (10) has a frame (12) which has a frame bed (12A) having a right-rear castor wheel (18RR), left-rear castor wheel (18LR), right-front castor wheel (18RF), and left-front castor wheel (18LF) mounted thereon. The lift and rotate dolly (10) further has a mast (14) securely mounted at a bottom distal end to the frame bed (12A). The mast (14) is vertically aligned and the frame bed (12A) is horizontally aligned forming a perpendicular angle therebetween. The mast (14) further has a mast slot (14A) positioned on a front side therein. The mast (14) further has at least one mast pulley (14F, 14R) rotatably mounted at a top distal end. The lift and rotate dolly (10) further has a lift (20) slidably mounted on the mast (14). The lift (20) comprises a lift pin (20) securely fastened at a front end to a lift plate (20B). The lift pin (20) is securely fastened at a rear end to a lift mast sleeve (20C) which is slidably mounted within the mast (14).

11 Claims, 2 Drawing Sheets

LIFT AND ROTATE DOLLY

DESCRIPTION OF THE PRIOR ART

Prior art lift inventions are is used to transport heavy objects and do not accommodate placing the lifted material into a confined space such as an elevator. The material is placed on the dolly and wheeled to the desired location. Due to the non-ability to lift or lower the front and or rear end of the material, prior art inventions cannot be utilized to transport material in confined spaces such as an elevator.

Numerous innovations for lifts have been provided in the prior art that are described as follows. Even though these innovations may be suitable for the specific individual purposes to which they address, they differ from the present invention as hereinafter contrasted.

In U.S. Pat. No. 5,449,266, titled Transporter for Heavy Loads, invented by Glen A. Evans, a transporter vehicle comprises two lifting devices which carry respective jacks and which can be joined at their ends by cross bars to form a rectangular dolly with a central opening therein. The lifting devices each have front and rear wheels so the dolly can be rolled on floor surfaces. In practice, they are placed on opposite sides of a load seated on a floor in the opening between those devices, the jacks are placed under the load, the cross bars are assembled with the side frames, the load is jacked up on its opposite sides to be above the floor and the load may then be transported.

The patented invention differs from the present invention because the patented invention functions to lift an object off of the floor by sliding underneath the object and lifts the object vertically. The present invention clamps on to a long objects and lifts rotates, and tips objects. The present invention has swivel casters on all four wheels. The patented invention has fixed wheels on two of the four wheels.

In U.S. Pat. No. 5,441,378, Snowmobile Lift Dolly, invented by Craig Puls, a dolly which can be easily placed under a snowmobile, to lift the front end of the snowmobile for easy movement and storage. The dolly includes a support frame, rollably supported on casters. A lift lever is pivotally attached to the support frame. A contact pad is mounted to a lift end of the lift lever, for contacting the underside of the snowmobile. The lift lever can move the contact pad between two positions, a raised position and a lowered position. The Lift lever includes a latch for latching the lever with the contact led in the raised position. An extension lever is removably attached to a lever end or the lift lever, to give additional leverage for lifting the snowmobile. Various embodiments are disclosed to accommodate structural differences among various makes end models of snowmobiles.

The patented invention differs from the present invention because the patented invention is a purpose built device adapted to transporting snowmobiles. The snowmobile is slid onto the patented invention. The object is not picked up or clamped to the patented invention. The present invention clamps on to a long objects and lifts rotates, and tips objects. The present invention has swivel casters on all four wheels. The patented invention has fixed wheels on two of the wheels.

In U.S. Pat. No. 5,415,516, titled Compact Trailer Having Hydraulic Fork Lift, invented by invented by Howard E. Richards, a compact utility trailer for pick-up and delivery of relatively small sized lots of material is readily towable behind a variety of commonly driven vehicles such as automobiles, pick-up trucks and the like, and contains a hand operated hydraulic jack-operated forklift that allows pallet of material to be easily seized and lifted into a transport position with in the confines of the trailer. The trailer comprises a front end hydraulic jack mounting portion, and a rear end pallet-housing portion affixed thereto to within which a pallet to be seized and transported. The front end hydraulic jack mounting portion has a long longitudinal member having a trailer hitch fixture. A floor is affixed to the front end portion, and a hydraulic jack mounted to the floor. A driven portion of the jack is vertically translated to engage a forklift-translating lever unit, which is coupled to a fork lift frame supported in the end portion of the trailer. The fork lift has generally L-shaped fork plates affixed to the fork lift frame, and fork and fork lift guide channels, in which vertical side members of the fork lift frame are vertically translatable. An attachment of the fork provides pivotable attachment of the fork lift frame to a lever arm of the fork lift-translating lever unit.

The patented invention differs from the present invention because the patented invention is a fork lift type of lifting device which positions forks under a load to be lifted. In the present invention, the load is placed on the cart/dolly and then lifted by clamping a lifting means to the load. Once lifted the load may be positioned in azimuth and yaw by the user so the object can be maneuvered into a confined space such as an elevator.

In U.S. Pat. No. 5,257,892, titled Multi Purpose Transporting Device, invented by David Branch a pipe machine dolly/cart combination is designed with spaced-apart wheels at both ends of a load carrying platform. Removable handles are provided to permit the dolly/cart combination to be manipulated from both ends to be rolled about on a surface, and to be pivoted about the wheels on either end. With the handles attached to one end, the dolly/cart may be manipulated by a single person to permit the loading of the cart to and from a raised surface, such as the bed of a truck. When the removable handles secured to the other end the device may used as a dolly to transport the load, and to deposit the load on a surface when the device is pivoted 90 degrees. The device is ideally suited for facilitating the loading and unloading and transportation, by a single person, of relatively heavy load, such as a pipe threading machine, or the like.

The patented invention differs from the present invention because the patented invention is a purpose built device to transport a pipe cutting machine, raise it to a operating height and position it onto a purpose built table. In the present invention, the load is placed on the cart/dolly and then lifted by clamping a lifting means to the load. Once lifted the load may be positioned in azimuth and yaw by the user so the object can be maneuvered into a confined space such as an elevator.

In U.S. Pat. No. 4,711,407, titled Roll Lifting, Transporting and Unrolling Dolly System and method, invented by Charles W. Boom a demountable roll and transport system has laterally spaced apart dollies, each comprising a set of front and rear ground-supported wheels with a wheel fork for each wheel. One of the forks of each set is formed with a journal and the other is formed with a shaft received coaxially in the journal to mount the wheel forks for movement between spread, roll-loading position and convergent, raised, roll-transport position. A lever swingably mounts to one of the forks of each set for fulcruming engagement with the periphery of one of the wheels to raise the wheel forks to transport position when the lever is pushed downwardly against the wheel. A demountable roll support extends between the dollies, and a releasable latch disengagably secures the wheel forks in roll-transport position.

The patented invention differs from the present invention because the patented invention is a purpose built device to transport and dispense rolls of roofing materials at a job sight. In the present invention, the load is placed on the cart/dolly and then lifted by clamping a lifting means to the load. Once lifted the load may be positioned in azimuth and yaw by the user so the object can be maneuvered into a confined space such as an elevator.

Numerous innovations for lifts have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to dollies. More particularly, the present invention relates to dollies that are capable of lifting and rotating material to be transported in an elevator. The present invention is used when transporting heavy objects which fit only caddy corned in an elevator. The objects are placed on the dolly and partially wheeled into the elevator. The clamping means is attached to the object and the winch used to raise the object. The user then changes the attitude of the object such that one end is pointed into a upper rear corner and the opposite end is lower to clear the front lower door corner on the opposite side from the upper rear corner.

The types of problems encountered in the prior art are limited front and rear liftability.

In the prior art, unsuccessful attempts to solve this problem were attempted namely: utilizing jacks at the front and rear end. However, the problem was solved by the present invention because a lift pin was utilized in conjunction with a lift plate to easily maneuver and tilt the material.

Innovations within the prior art are rapidly being exploited in the field of ergodynamically designing construction material.

The present invention went contrary to the teaching of the art which teaches vertical lifting means.

The present invention solved a long felt need for a lifting and transporting device which could easily transport material in confined spaces such as an elevator.

The present invention produced unexpected results namely: by facilitating transportation of material, more material could be transported in lesser time which reduced the overall cost of construction.

Accordingly, it is an object of the present invention to provide a lift and rotate dolly.

More particularly, it is an object of the present invention to provide a lift and rotate dolly which comprises a frame consisting of a frame bed optionally having a frame front stanchion and a frame rear stanchion extending vertically upwardly therefrom and a frame middle connector therebetween.

In keeping with these objects, and with others which will become apparent hereinafter, one feature of the present invention resides, briefly stated, in the a lift and rotate dolly which further comprises a mast having a mast slot. The mast preferably comprises a mast front pulley and a mast rear pulley.

When the winch is designed in accordance with the present invention, it preferably comprises a winch rear pulley having a winch rear pulley cable attached thereto and a winch front pulley having a winch front pulley cable attached thereto.

In accordance with another feature of the present invention, the frame bed has a right-rear castor wheel, left-rear castor wheel, right-front castor wheel, and a left-front castor wheel attached thereto.

Another feature of the present invention is that the lift comprises a lift pin securely attached to a lift plate and rotatably mounted within a lift mast sleeve which is slidably mounted within the mast.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10 - lift and rotate dolly (10)
12 - frame (12)
12A - frame bed (12A)
12F - frame front stanchion (12F)
12R - frame rear stanchion (12R)
12M - frame middle connector (12M)
14 - mast (14)
14A - mast slot (14A)
14F - mast front pulley (14F)
14R - mast rear pulley (14R)
16 - winch (16)
16R - winch rear pulley (16R)
16RA - winch rear pulley cable (16RA)
16F - winch front pulley (16F)
16FA - winch front pulley cable (16FA)

18RR - right-rear castor wheel (18RR)
18LR - left-rear castor wheel (18LR)
18RF - right-front castor wheel (18RF)
18LF - left-front castor wheel (18LF)
20 - lift (20)
20A - lift pin (20)
20B - lift plate (20B)
20C - lift mast sleeve (20C)
22 - material (22)

DESCRIPTION OF THE PREFERRED EMBODIMENT

Figure 1:
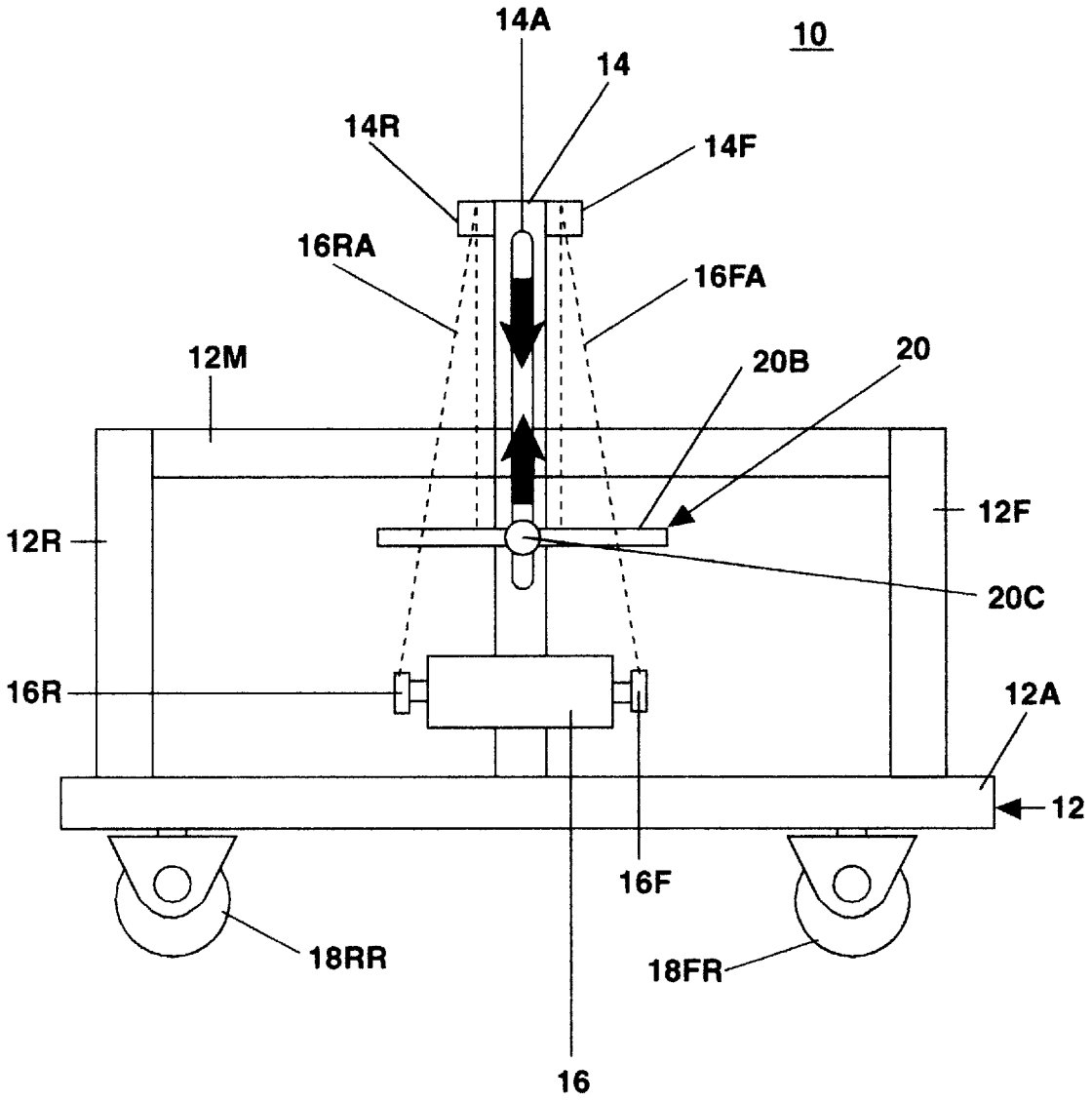
FIG. 1 is a front view of a lift and rotate dolly.
Figure 2:
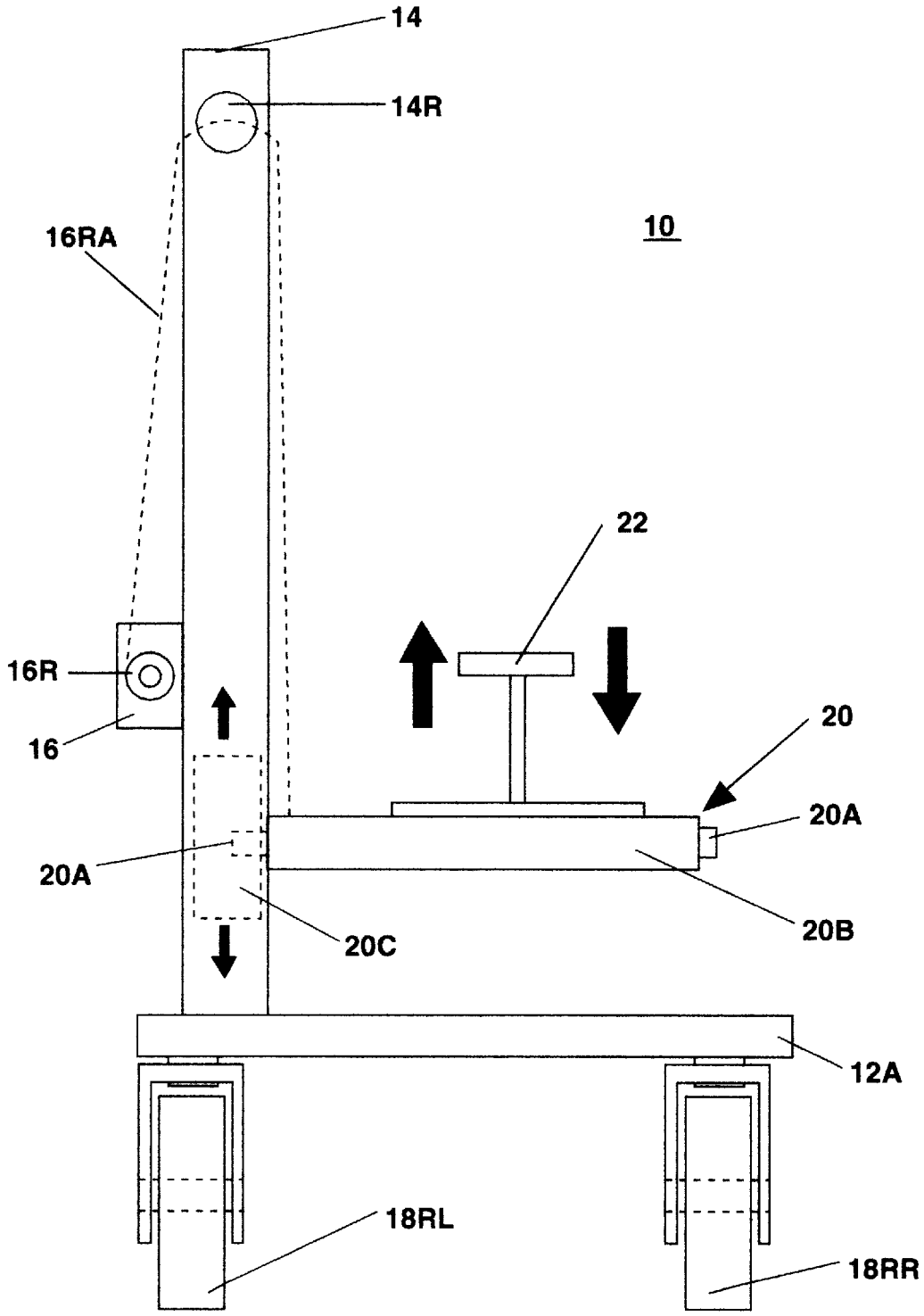
FIG. 2 is a rear view of a lift and rotate dolly.

Referring to FIG. 1 and FIG. 2 which are a front and rear view, respectively, of a lift and rotate dolly (10). The lift and rotate dolly (10) functions to allow a user to lift and rotate material (22) in situations where space is limited such as an elevator. The lift and rotate dolly (10) comprises a frame (12) which comprises a frame bed (12A) having a right-rear castor wheel (18RR), left-rear castor wheel (18LR), right-front castor wheel (18RF), and left-front castor wheel (not shown) mounted thereon. The castor wheels (18RR, 18LR, 18LL, 18RL) are preferably eight inches in height. The frame (12) further comprises a frame front stanchion (12F) securely fastened at a bottom distal end to a front end of the frame bed (12A). The frame (12) further comprises a frame rear stanchion (12R) securely fastened at a bottom distal end to a rear end of the frame bed (12A). The frame (12) further comprises a frame middle connector (12M) securely fastened at front distal end to a top distal end of the frame front stanchion (12F) and securely fastened at rear distal end to a top distal end of the frame rear stanchion (12R) and securely fastened at a middle to the mast (14). The frame front stanchion (12F) and the frame rear stanchion (12R) and the frame middle connector (12M) function in unison to strengthen the attachment of the mast (14) to the frame bed (12A) enabling heavier material (22) to be lifted and rotated upon the lift (20). The frame bed (12A) is in the range from three to five feet in length but preferably is four feet in length. The frame bed (12A) is in the range from two to four feet in width but preferably is three feet in width.

The lift and rotate dolly (10) further comprises a mast (14) securely mounted at a bottom distal end to the frame bed (12A). The mast (14) is vertically aligned and the frame bed (12A) is horizontally aligned forming a perpendicular angle therebetween. The mast (14) further comprises a mast slot (14A) positioned on a front side therein. The mast (14) further comprises at least one mast pulley (14F, 14R) rotatably mounted at a top distal end. The mast (14) comprises a mast front pulley (14F) rotatably mounted at a top front distal end of the mast (14) and a mast rear pulley (14R) rotatably mounted at a top rear distal end of the mast (14). The mast (14) has a height in the range from six to nine feet but is preferably has a height in the range from seven to eight feet.

The lift and rotate dolly (10) further comprises a lift (20) slidably mounted on the mast (14). The lift (20) comprises a lift pin (20A) securely fastened at a front end to a lift plate (20B). The lift pin (20A) is pivotally fastened at a rear end to a lift mast sleeve (20C) which is slidably mounted within the mast (14). The lift pin (20A) transcends through and is slidably within the mast slot (14A).

The lift and rotate dolly (10) further comprises a winch (16) securely mounted on a rear side of the mast (14).The lift plate (20B) has a width in the range between one and three feet but preferably has a width in the range of two feet. The winch (16) further comprises at least one wench pulley (16F, 16R) having at least one winch pulley cable (16FA, 16RA) securely attached at a rear distal end thereon. A front distal end of the at least one winch pulley cable (16FA, 16RA) is securely attached at a front distal end to the lift (20) such that when a user actuates the winch (16), the lift (20) is moved upward or downward. In addition, the user can pivot the material (22) upon the lift (20) in an upward and downward direction. The frame front stanchion (12F) and the frame rear stanchion (12R) have a height in the range from two to four feet but preferably have a height of three feet. The winch (16) further comprises a wench rear pulley (16R) having a winch rear pulley cable (16RA) securely attached at a rear distal end thereon and movably positioned on the mast rear pulley (14R). The winch rear pulley cable (16RA) is securely attached at a front distal end to a rear side of the lift plate (20B). The wench (16) further comprises a winch front pulley (16F) having a winch front pulley cable (16FA) securely attached at a rear distal end thereon and movably positioned on the mast front pulley (14F). The winch front pulley cable (16FA) is securely attached at a front distal end to a front side of the lift plate (20B). The winch rear pulley (16R) and the winch front pulley (16F) function as follows:

i) when a user reels in the winch rear pulley cable (16RA) onto the wench rear pulley (16R) and concurrently reels in the winch front pulley cable (16FA) onto the front pulley (16F), the lift (20) moves in an upward direction;

ii) when a user reels out the winch rear pulley cable (16RA) from the winch rear pulley (16R) and concurrently reels out the winch front pulley cable (16FA) from the front pulley (16F), the lift (20) moves in a downward direction;

iii) when a user reels in the winch rear pulley cable (16RA) onto the winch rear pulley (16R) and concurrently reels out the winch front pulley cable (16FA) from the front pulley (16F), the lift plate (20B) tilts upwardly at the rear side and tilts downwardly at the front side; and iv) when a user reels out the winch rear pulley cable (16RA) from the winch rear pulley (16R) and concurrently reels in the winch front pulley cable (16FA) onto the front pulley (16F), the lift plate (20B) tilts downwardly at the rear side and tilts upwardly at the front side.

The winch (16) is selected from a group consisting of hydraulic winches, pneumatic winches, manually operated winches, and electric winches.

The lift and rotate dolly (10) is constructed from a material selected from a group consisting of metal, metal alloy, plastic, plastic composite, rubber composite, fiberglass, epoxy, and carbon-graphite.

It will be understood that each of the elements described above, or two or more together, may also find a useful application in other types of constructions differing from the type described above.

While the invention has been illustrated and described as embodied in a lift and rotate dolly, it is not intended to be limited to the details shown, since it will be understood that various omissions, modifications, substitutions and changes in the forms and details of the device illustrated and in its operation can be made by those skilled in the art without departing in anyway from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A lift and rotate dolly (10) comprising:

A) a frame (12) which comprises a frame bed (12A) having a right-rear castor wheel (18RR), left-rear castor wheel (18LR), right-front castor wheel (18RF), and left-front castor wheel (18LF) mounted thereon, the frame (12) further comprises a frame front stanchion (12F) securely fastened at a bottom distal end to a front end of the frame bed (12A), the frame (12) further comprises a frame rear stanchion (12R) securely fastened at a bottom distal end to a rear end of the frame bed (12A), the frame (12) further comprises a frame middle connector (12M) securely fastened at a front distal end to a top distal end of the frame front stanchion (12F) and securely fastened at a rear distal end to a top distal end of the frame rear stanchion (12R), the frame bed (12A) is in the range from three to five feet in length;

B) a mast (14) securely mounted at a bottom distal end to the frame bed (12A), the mast (14) is vertically aligned and the frame bed (12A) is horizontally aligned forming a perpendicular angle therebetween, the mast (14) further comprises a mast slot (14A) positioned on a front side therein, the mast (14) comprises a mast front pulley (14F) rotatably mounted at a top front distal end of the mast (14) and a mast rear pulley (14R) rotatably mounted at a top rear distal end of the mast (14), the mast (14) has a height in the range from six to nine feet, the frame middle connector (12M) is securely fastened at a middle to the mast (14);

C) a lift (20) slidably mounted on the mast (14), the lift (20) comprises a lift pin (20) securely fastened at a front end to a lift plate (20B), the lift pin (20) is pivotally fastened at a rear end to a lift mast sleeve (20C) which is slidable mounted within the mast (14), the lift pin (20) is positioned through the mast slot (14A) and is slidable therein;

D) a winch (16) securely mounted on a rear side of the mast (14), the winch (16) comprises a winch rear pulley (16R) having a winch rear pulley cable (16RA) securely attached at a rear distal end thereon and movably positioned on the mast rear pulley (14R), the winch rear pulley cable (16RA) is securely attached at a front distal end to a rear side of the lift plate (20B), the winch (16) further comprises a winch front pulley (16F) having a winch front pulley cable (16FA) securely attached at a rear distal end thereon and movably positioned on the mast front pulley (14F), the winch front pulley cable (16FA) is securely attached at a front distal end to a front side of the lift plate (20B).

2. The lift and rotate dolly (10) as described in claim 1, wherein the frame bed (12A) is four feet in length.

3. The lift and rotate dolly (10) as described in claim 1, wherein the frame bed (12A) is three feet in width.

4. The lift and rotate dolly (10) as described in claim 1, wherein the mast (14) has a height in the range from seven to eight feet.

5. The lift and rotate dolly (10) as described in claim 1, wherein the castor wheels (18RR, 18LR, 18LL, 18RL) are eight inches in height.

6. The lift and rotate dolly (10) as described in claim 1, wherein the frame front stanchion (12F) and the frame rear stanchion (12R) have a height in the range from two to four feet.

7. The lift and rotate dolly (10) as described in claim 6, wherein the frame front stanchion (12F) and the frame rear stanchion (12R) have a height of three feet.

8. The lift and rotate dolly (10) as described in claim 1, wherein the lift plate (20B) has a width in the range between one and three feet.

9. The lift and rotate dolly (10) as described in claim 8, wherein the lift plate (20B) has a width of substantially two feet.

10. The lift and rotate dolly (10) as described in claim 1 wherein the components are constructed from a material selected from a group consisting of metal, metal alloy, plastic, plastic composite, rubber composite, fiberglass, epoxy, and carbon-graphite.

11. The lift and rotate dolly (10) as described in claim 1, wherein the winch (16) is selected from a group consisting of hydraulic winches, pneumatic winches, manually operated winches, and electric winches.

* * * * *